US008141507B2

(12) United States Patent
Allen

(10) Patent No.: US 8,141,507 B2
(45) Date of Patent: Mar. 27, 2012

(54) APPARATUS, SYSTEM, AND METHOD FOR FACILITATING THE INSTRUCTION OF QUILTING TECHNIQUES

(76) Inventor: Renae Gilbert Allen, Brigham City, UT (US)

( * ) Notice: Subject to any disclaimer, the term of this patent is extended or adjusted under 35 U.S.C. 154(b) by 878 days.

(21) Appl. No.: 12/189,667

(22) Filed: Aug. 11, 2008

(65) Prior Publication Data

US 2009/0038521 A1 Feb. 12, 2009

Related U.S. Application Data

(60) Provisional application No. 60/964,152, filed on Aug. 9, 2007.

(51) Int. Cl.
*D05B 11/00* (2006.01)
*D05B 81/00* (2006.01)

(52) U.S. Cl. ..... 112/475.08; 112/475.17; 112/117

(58) Field of Classification Search ..... 112/117–119, 112/103, 470.14, 475.01, 475.08, 475.17, 112/475.18

See application file for complete search history.

(56) References Cited

U.S. PATENT DOCUMENTS

| | | | | |
|---|---|---|---|---|
| 889,614 | A * | 6/1908 | Johnsen | 112/475.18 |
| 4,636,099 | A * | 1/1987 | Goldstone | 400/531 |
| 4,640,529 | A * | 2/1987 | Katz | 281/5 |
| 4,814,218 | A * | 3/1989 | Shane | 428/102 |
| 2003/0091783 | A1 * | 5/2003 | Calandrino | 428/89 |
| 2006/0096510 | A1 * | 5/2006 | Kuki et al. | 112/102.5 |
| 2007/0199466 | A1 * | 8/2007 | Franz | 101/485 |
| 2007/0251111 | A1 * | 11/2007 | Barry | 33/562 |

* cited by examiner

*Primary Examiner* — Ismael Izaguirre
(74) *Attorney, Agent, or Firm* — Kunzler Needham Massey & Thorpe

(57) ABSTRACT

An apparatus to facilitate the instruction of quilting techniques includes a background pattern and a stitching pattern printed on a fabric panel. The fabric panel may be a length of fabric configured to receive inks which define the background pattern and the stitching pattern. The background pattern may be a plurality of geometric shape arranged to simulate one or more quilted fabric designs such as those designs found on a typical quilted fabric. The stitching pattern includes at least one quilting stitching design which defines a guideline for stitching the stitching pattern. The apparatus also includes at least one instructional mark printed on the fabric panel. The instructional mark defines a quilting instruction which guides a user in stitching the stitching pattern.

19 Claims, 9 Drawing Sheets

APPARATUS, SYSTEM, AND METHOD FOR FACILITATING THE INSTRUCTION OF QUILTING TECHNIQUES

CROSS-REFERENCES TO RELATED APPLICATIONS

This application claims priority to U.S. Provisional Patent Application No. 60/964,152 entitled "Machine Quilting Fabric Panels—A fabric material with printed patterns which act as guidelines, arcs, and shapes for the development of machine quilting skills. The fabric features a diversity of basic and common patterns incremental in difficulty with instructional marks to indicate preferred stitching directions, as well as a diversity of underlying patterns to quilt by tracing or extrapolation of a pattern." and filed on Aug. 9, 2007 for Renae Gilbert Allen, which is incorporated herein by reference.

BACKGROUND

1. Field of the Invention

This invention relates to the instruction of textile assembly and more particularly relates to the teaching and learning of machine quilting techniques.

2. Description of the Related Art

Quilting is a method of textiles assembly by which two or more layers of fabric are stitched together at intervals with a filler material (batting) in between and is commonly used for blankets and decorations. The quilting stitches are often laid in lines and curves which form a decorative pattern. Decorative machine quilted (stitched) patterns add to both the aesthetic quality and value of a finished quilt textile.

The fabric layers used for the top side of a quilted textile are often made up of many smaller pieces of fabric which have been sewn together (pieced) to form a decorative mosaic, a typically labor-intensive process. In well-designed quilted textiles, the underlying pattern formed by joined pieces of fabric or a printed design is complemented by a coordinating overlying pattern of quilting stitches. The back or underside of a quilted textile is commonly of simple construction and plain material.

Quilting (stitching) can be done by hand, or, commonly, via sewing machine (machine quilting). Machine quilting can be done using most consumer sewing machines or long arm machines with sufficient precision, greater speed and less strain than hand stitching.

Learning the art of machine quilting requires time and practice. Beginning machine quilters are hesitant to practice machine-aided stitching (machine quilting) on valuable pieces of fabric or pieces of quilting fabric whose preparation has required time and care. A system for the instruction and learning of machine quilting patterns and techniques is needed to aid beginners in acquiring machine quilting skills.

SUMMARY

From the foregoing discussion, it should be apparent that a need exists for an apparatus, system, and method that aids in learning and teaching machine quilting. Beneficially, such an apparatus, system, and method would provide a diversity of ready-made or preprinted patterns in a disposable form with physical properties similar or identical to actual quilt fabrics.

The present invention has been developed in response to the present state of the art, and in particular, in response to the problems and needs in the art that have not yet been fully solved by currently available quilting instruction systems.

Accordingly, the present invention has been developed to provide an apparatus, system, and method for facilitating the instruction of quilting techniques that overcomes many or all of the above-discussed shortcomings in the art.

A need exists for an aid in learning and teaching machine quilting which provides a diversity of ready-made or preprinted patterns in a disposable form with material properties similar or identical to actual quilt fabrics. Additionally, it is desirable for such an aid to feature instructional markings and organization of patterns incremental in stitching difficulty, as well as a variety of underlying blocks and motifs on which the stitching patterns may be practiced via both tracing and extrapolation.

The apparatus to facilitate the instruction of quilting techniques includes a background pattern and a stitching pattern printed on a fabric panel. The fabric panel may be a length of fabric configured to receive inks which define the background pattern and the stitching pattern. The background pattern may be a plurality of geometric shapes arranged to simulate one or more quilted fabric designs such as those designs found on a typical quilted fabric. The stitching pattern includes at least one quilting stitching design which defines a guideline for stitching the stitching pattern. The apparatus also includes at least one instructional mark printed on the fabric panel. The instructional mark defines a quilting instruction which guides a user in stitching the stitching pattern.

The stitching pattern, in one embodiment, is configured with a first portion having a continuous uninterrupted guideline illustrating the quilting stitching design. The stitching pattern may also include a second portion having an interrupted section wherein the guideline illustrating the at least one quilting stitching design is interrupted.

In one embodiment the geometric shapes which makeup the background pattern are arranged in a repeating pattern to simulate a patchwork quilt. In certain embodiments the stitching pattern is printed on top of the background pattern to facilitate the practice of stitching the stitching pattern within the pattern of the background pattern as would be done with a real patchwork quilt.

A stitching device selected such as a conventional sewing machine, a long arm sewing machine or a needle and thread may be used with the apparatus and to assist the user in stitching the stitching pattern according to the quilting instruction defined by the at least one instructional mark.

In certain embodiments the instructional mark may be a label defining a starting point for beginning stitching of the stitching pattern, a label defining an ending point for ending stitching of the stitching pattern, a label identifying direction to stitch the stitching pattern or a sequence identifier identifying a proper sequence of stitching strokes for completion of the stitching pattern. In one embodiment unique line styles may be used to distinguish each stitching stroke.

In one embodiment the stitching pattern and the instructional marks may be printed using a removable material such as a removable ink so that the stitching pattern and instructional marks may be removed after the user has stitched the stitching pattern.

A system of the present invention is also presented to facilitate the instruction of quilting techniques. The system may be embodied in a fabric panel consisting of a length of fabric for receiving a background pattern and a stitching pattern. In particular, the system, in one embodiment, includes a background pattern printed on the fabric panel. The background pattern may contain a plurality of geometric shapes arranged in a repeating pattern to simulate a patchwork quilt. A stitching pattern is printed on top of the background pattern. The stitching pattern defines a guideline for stitching a quilting stitching design. In certain embodiments, because the stitching pattern is printed on top of the background pattern a user may practice stitching the stitching pattern within the repeating pattern of the background pattern. The system also includes at least one instructional mark printed on the fabric panel. The instructional marks define quilting instructions that guide users ion stitching the stitching pattern.

The stitching pattern of the system may further include a first portion having a continuous uninterrupted guideline and a second portion having an interrupted guideline. Thus, in certain embodiments the user may be required to extrapolate the stitching pattern where the guide line is interrupted in the second portion.

In one embodiment the system may also include a second fabric panel having a second stitching pattern printed thereon. The second stitching pattern may contain patterns which are incrementally more difficult to sew than the stitching pattern on the first fabric panel. Thus, the system may include a plurality of fabric panels with each fabric panel incrementally more difficult to sew than the previous fabric panel. In this fashion a user may practice quilting skills which are progressively more difficult.

A method of the present invention is also presented for facilitating the instruction of quilting techniques. The method in the disclosed embodiments substantially includes the steps necessary to carry out the functions presented above with respect to the operation of the described apparatus and system. In one embodiment, the method includes printing a background pattern on a fabric panel. The fabric panel may have a plurality of geometric shapes simulating one or more quilted fabric designs found on a quilted fabric. The method also may include printing a stitching pattern on the fabric panel. The stitching pattern may simulate a quilting stitching design. The stitching pattern defines a guideline for stitching the quilted stitching design. The method may also include printing at least one instructional mark on the fabric panel. The instructional mark defines a quilting instruction. The method may also include guiding a user to stitch the stitching pattern according to the at least one instructional mark.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
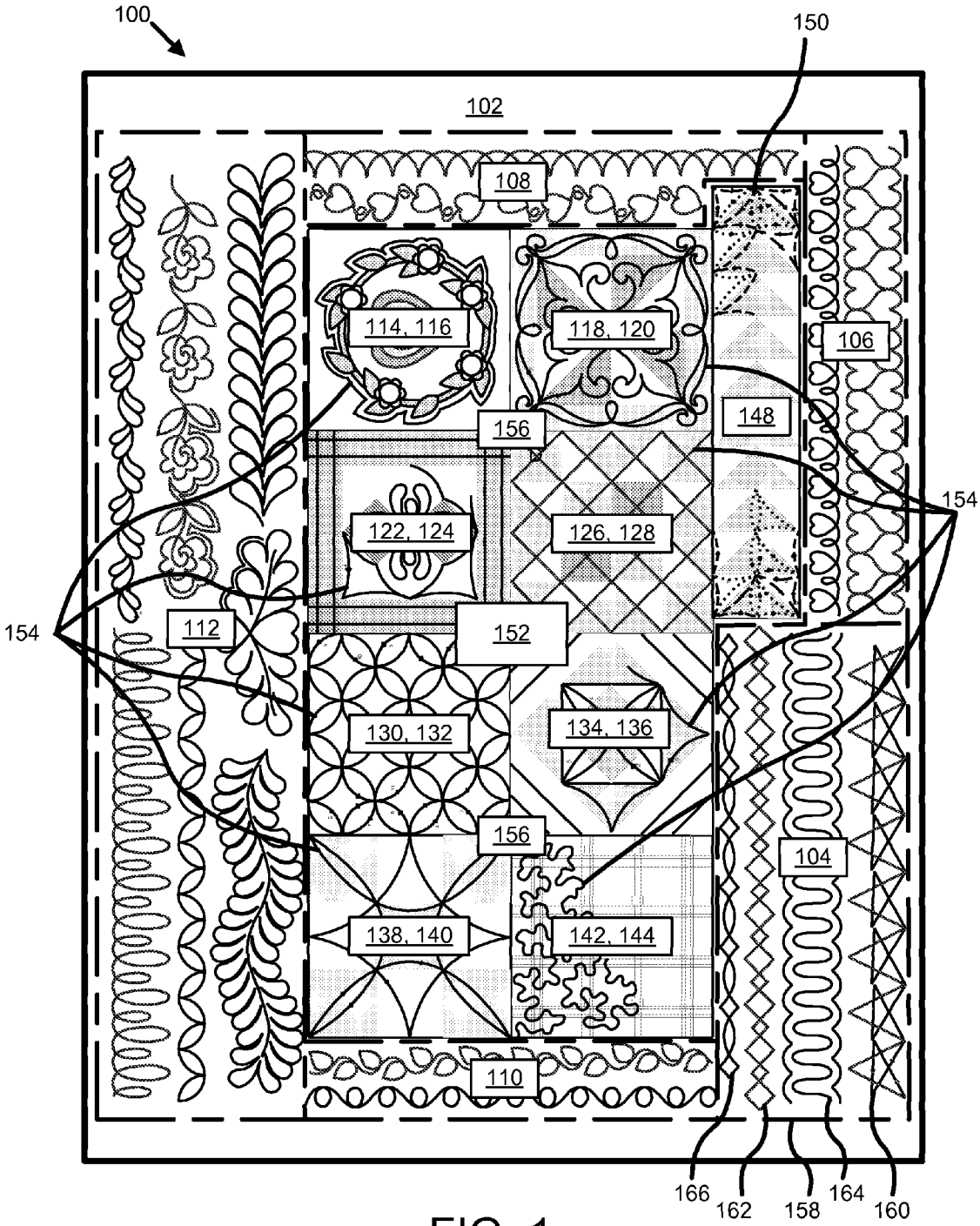
FIG. 1 is a top view illustrating one embodiment of a fabric panel containing a plurality of background patterns and stitching patterns in accordance with the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are discussed to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In one way of quilting stitching patterns are printed on a paper which can be pinned to the fabric, stitched through, and then torn away after stitching. Paper is generally more rigid than pliable quilting fabrics, so additional skill is required for the use of this technique. Like other aspects of quilting, pattern transfer techniques can be time consuming.

The prior art does not address the needs of the novice machine quilter in the following ways. 1) Fixing and stitching paper patterns over fabric presents an additional technical challenge for novices. 2) In order to acquire competence in machine quilting, a novice needs practice sewing a variety of contrasting patterns which integrate various linear and circular movements. 3) For the purposes of machine quilting practice in home and classroom settings, a ready-made material is desirable over paper pattern and stencil-based pattern transfer technologies, which require additional time for preparation. 4) Quilting (stitching) patterns generally include overlapping and intersecting lines of stitches which can, if machine sewn properly, be done with a minimum of (time consuming) discontinuities. However, preferred stitching directions are not self-evident in printed lines and arcs. Thus, pedagogical ("instructional") markings are desirable for novice machine quilters, though not aesthetic in the appearance of a finished quilt. 5) For a novice, the matching of stitching patterns with various arrangements (blocks) of pieced fabrics or fabric print patterns is nontrivial. Furthermore, experienced quilters can often stitch designs without the aid of transferred patterns, by registering a stitching pattern to an underlying pattern in the fabric. Also, transferred designs which are complete, in the sense that no portion of the stitching pattern is deliberately omitted, facilitate tracing only, but do not give a learner a chance to extrapolate and continue a stitching pattern on top of an underlying fabric pattern.

FIG. 1 depicts a system 100 for facilitating the instruction of quilting techniques. The system 100 includes a fabric panel 102 with a plurality of common stitching patterns illustrated thereon such as the common stitching patterns illustrated in areas 104, 106, 108, 110, and 112. Additional stitching patterns 116, 120, 124, 128, 132, 136, 140 and 144 (collectively additional stitching patterns 154) are printed on the fabric panel 102 on top of background patterns 114, 118, 122, 126, 130, 134, 138 and 142 (collectively background patterns 156) respectively. In one embodiment the background patterns 114, 118, 122, 126, 130, 134, 138 and 142 make up a simulated quilt patchwork 152. Extrapolation stitching pattern 150 is printed on background pattern 148 in certain embodiments.

In certain embodiments before practicing stitching the various stitching patterns illustrated on the fabric panel 102 the user may prepare the fabric panel 102 with a batting (not shown) to simulate the quilting experience.

The common stitching patterns illustrated in areas 104, 106, 108, 110, and 112 may vary in difficulty in terms of complexity of the designs comprising the stitching patterns as well as the linear or circular motions required to complete the common stitching pattern. For example in certain embodiments area 104 may include relatively simple stitching patterns containing straight line stitching patterns such as the stars border stitching pattern 160 or the diamond border stitching pattern 162. Similarly, area 104 may also have simple arc or rounded stitching patterns such as the wave border stitching pattern 164 or the pearl and square border stitching pattern 166.

Areas 106, 108, 110 and 112 may contain incrementally more difficult stitching patterns to guide a user in stitching more complex patterns. In certain embodiments the stitching patterns contained within areas 106, 108, 110, and 112 may be ordered in a sequential pattern around the outer edge of the fabric panel 102 according to a predefined pattern wherein each area 106, 108, 110, and 112, contains an increasingly more difficult set of stitching patterns such that a user may complete one area before moving on to another more complex area. A user may stitch one area 106, 108, 110, and 112 of stitching patterns containing stitching patterns of similar difficulty before moving on to the next area. In this manner a user masters the skills required to complete each area 104, 106, 108, 110, and 112 before moving on to the next area.

In other embodiments the stitching patterns may be randomly distributed on the fabric panel 102 without any weight given to the difficulty of the pattern. In one embodiment the stitching patterns contained within areas 104, 106, 108, 110, and 112 may teach a user the more common stitching patterns used in typical quilts. Thus, by completing the stitching patterns contained within areas 104, 106, 108, 110, and 112 a user may acquire a general understanding and proficiency in stitching common stitching patterns used in quilting. One skilled in the art will recognize that the stitching patterns contained within areas 104, 106, 108, 110, and 112 are illustrative of common stitching patterns and are intended to illustrate one example of stitching patterns which may be printed on fabric panel 102. In other embodiments other stitching patterns may be illustrated on areas 104, 106, 108, 110, and 112. Further, in other embodiments areas 104, 106, 108, 110, and 112 may be found elsewhere on the fabric panel 102. Accordingly, areas 104, 106, 108, 110, and 112 are intended to illustrate one example of an arrangement which may include the fabric panel 102. Similarly, in certain embodiments one or more areas 104, 106, 108, 110, and 112 may be omitted all together. In one embodiment all of the areas 104, 106, 108, 110, and 112 may be omitted such that the fabric panel 102 only contains the simulated quilt patchwork 152.

While areas 104, 106, 108, 110, and 112 are illustrated with a dashed line 158 surrounding each area 104, 106, 108, 110, 112, one skilled in the art will recognize that the current invention may be practiced without such dashed line 158. Therefore, in one embodiment the dashed line 158 may be omitted such that there is no physical boundary separating areas 104, 106, 108, 110, and 112.

The simulated quilt patchwork 152 includes a plurality of background patterns such as background patterns 114, 118, 122, 126, 130, 134, 138 and 142. In the embodiment illustrated in FIG. 1, each background patterns 114, 118, 122, 126, 130, 134, 138 and 142 includes a plurality of geometric shapes combined to simulate an individual patch in a patchwork quilt. For example, background pattern 138 includes nine squares of alternating colors to create a checkerboard pattern. The checkerboard pattern of background pattern 138 simulates an individual patch as may be found in a traditional patchwork quilt. Likewise, background pattern 118 includes a border surrounding alternating triangles. One skilled in the art will recognize that numerous background patterns such as background patterns 122, 134, 136 or others may include the simulated quilt patchwork 152. Similarly, in certain embodiments the background may include a blank background such as background pattern 114 or background pattern 130 interspersed throughout the simulated quilt patchwork 152. Further, while the background patterns 114, 118, 122, 126, 130, 134, 138 and 142 in FIG. 1 include a random assortment of patterns, one skilled in the art will recognize that in certain embodiments the background patterns 114, 118, 122, 126, 130, 134, 138 and 142 may be arranged in a repeating pattern as is often done in a sewn patchwork quilt.

Additional stitching patterns 116, 120, 124, 128, 132, 136, 140 and 144 are printed on the fabric panel 102 on top of background patterns 114, 118, 122, 126, 130, 134, 138 and 142 respectively. By printing the additional stitching patterns 154 on top of the background patterns 156 the user practices stitching the additional stitching patterns 154 within the confines of the background patterns 156. Thus, a real world quilting project is simulated by stitching over a simulated patchwork quilt. One skilled in the art will recognize that in certain embodiments a user may be instructed to stitch any additional lines within the background such as the unlabeled solid straight lines between background patterns 114, 118, 122, 126, 130, 134, 138 and 142.

Each of the stitching patterns contained within areas 104, 106, 108, 110, and 112 as well as the additional stitching patterns 154 include a guideline for stitching a quilting stitching design. As discussed above, the quilting stitching design may include a common quilting stitching design, or the quilting stitching design may include a design that fits or compliments a particular background pattern such as background patterns 156. In one embodiment the additional stitching patterns 154 may be printed on the fabric panel 102 using a removable ink that may be removed from the fabric panel 102 after the stitching patterns 154 have been stitched.

In certain embodiments the additional stitching patterns 154 may include a first portion and a second portion. The first portion may have a continuous uninterrupted pattern to help a user start a stitching pattern. In the second portion, the guideline may be interrupted such that the user has to extrapolate the proper design to finish stitching pattern. For example, background pattern 148 illustrates an extrapolation stitching pattern 150 wherein the user must extrapolate the remaining stitching strokes to finish the design.

Figure 2:
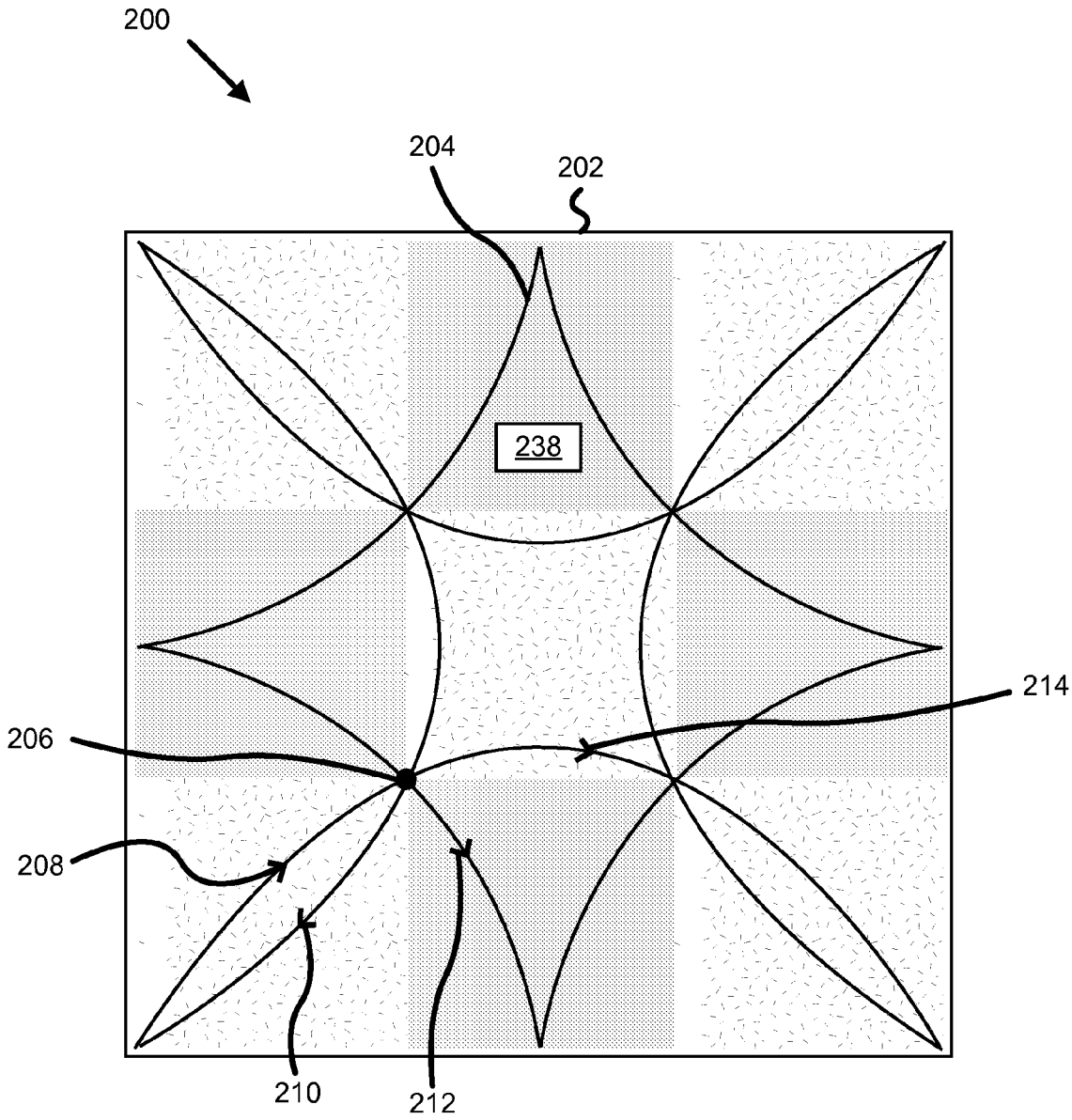
FIG. 2 is a top view illustrating an embodiment a background pattern having a stitching pattern and instructional marks printed thereon in accordance with the present invention.

FIG. 2 illustrates one embodiment of a system 200 for facilitating the instruction of quilting techniques. The system 200 has a background pattern 238 printed on a fabric panel 202, a stitching pattern 204 and a plurality of instructional marks 206, 208, 210, 212 and 214. In certain embodiments the system 200 includes one of the additional stitching patterns 154 and background patterns 156 of system 100 such as stitching pattern 140 and background pattern 138. In another embodiment the system 200 includes a complete system for facilitating the instruction of quilting techniques. In certain embodiments instructional marks may also include differing line styles for different stitching strokes as described below.

In certain embodiments the entire system 200 includes a fabric panel 202 with a single background pattern 238. In one embodiment the system 200 includes a number of fabric panels 202 each fabric panel 202 having a unique background pattern 238 and a unique stitching pattern 204. In other embodiments the background pattern 238 may be the same with a unique stitching pattern 204 on each fabric panel 202. In yet another embodiment the fabric panel 202 includes a plurality of background patterns such as the background patterns 118, 122, 126, 134, 138, 142 of FIG. 1. One skilled in the art will recognize that the current invention is not limited to the background patterns illustrated herein but rather, any number of designs may include the background pattern 238.

A stitching pattern 204 is printed on the background 238. Instructional marks include a starting point label 206 and direction indicators 208, 210, 212 and 214 which define quilting instruction that guides a user in stitching the stitching pattern. In certain embodiments the instructional marks such as starting point label 206 and direction indicators 208, 210, 212 and 214 may define the preferred stitching sequence and direction to complete the stitching pattern. For example starting point label 206 may define a starting point to begin sewing stitching pattern 204. Direction indicator 212 defines a first stitching stroke and direction. In the embodiment illustrated in FIG. 2, direction indicator 212 is an arrow indicating the direction of the stitching stroke. Accordingly, in use a user follows the stitching pattern 204 in the direction indicated by direction indicator 212 until the user has returned to the starting point 206. Direction indicators 210, 208 and 214 are also arrows indicating the direction of additional stitching strokes. Accordingly, once the user has returned to the starting point, the user then follows direction indicators 210, 208 and 214 to complete the stitching pattern 204 without double stitching or using more than one starting point. With practice a user acquires a proficiency in stitching. Similarly, as a user practices stitching patterns with minimal starting points and without doubling back over previous stitches the user becomes proficient in recognizing efficient stitching strokes.

Figure 3:
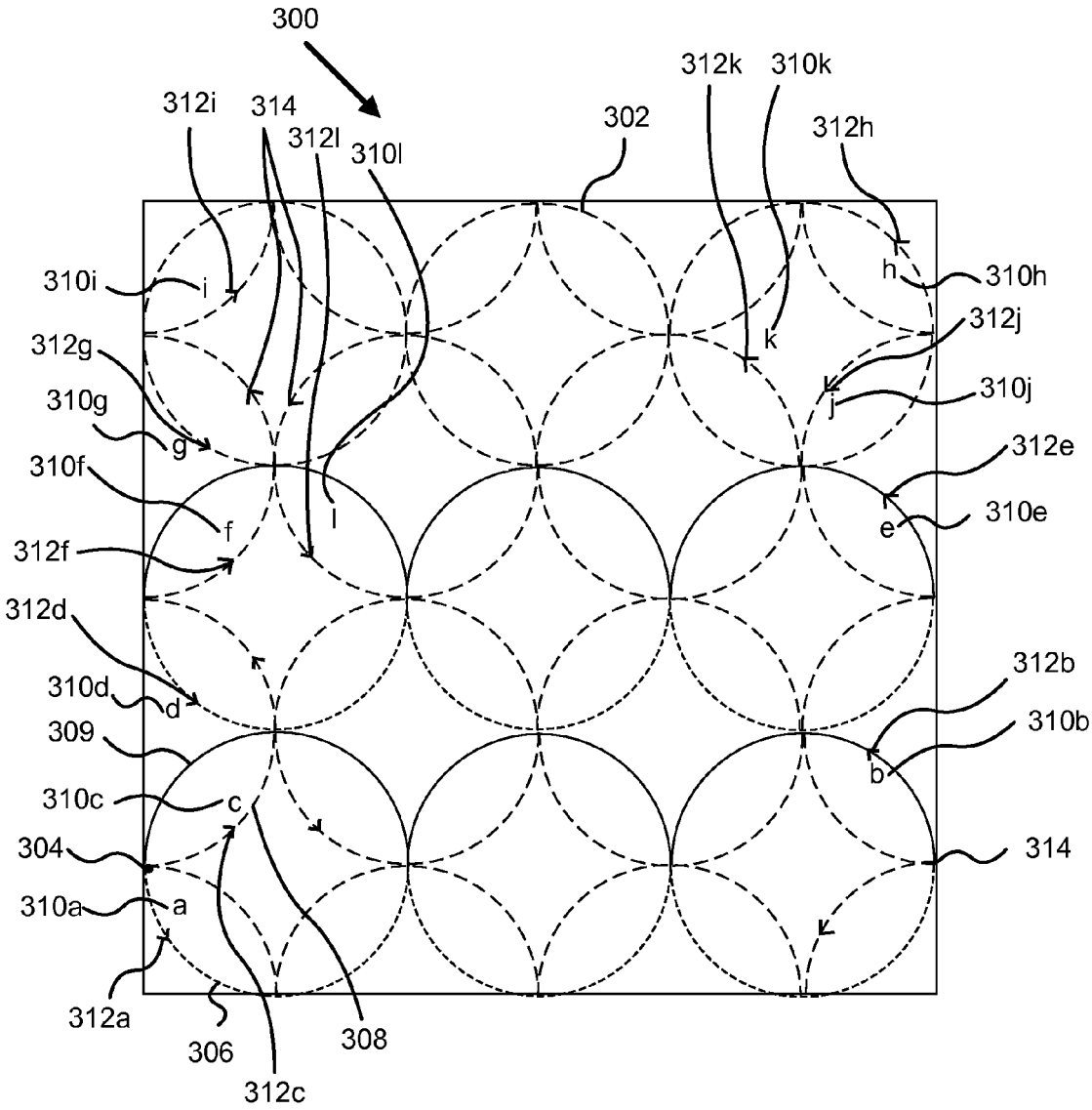
FIG. 3 is a top view illustrating an embodiment of a stitching pattern having a plurality of stitching stroke sequence identifiers printed thereon in accordance with the present invention.

FIG. 3 illustrates another embodiment of a system 300 for facilitating the instruction of quilting techniques. The system 300 includes a stitching pattern 302 having a starting point 304, a plurality of lines styles 306, 308 and 310, a set of sequence identifiers 310*a*-310*l* identifying a proper sequence of stitching strokes for completion of the stitching pattern, and a set of direction indicators 312*a*-312*l*. In certain embodiments the system 300 includes one of the stitching patterns 154 and background patterns 156 of system 100 such as stitching pattern 132 and background pattern 130. In another embodiment the system 300 includes a complete system for facilitating the instruction of quilting techniques.

Direction indicators 312*a*-312*l* indicate the proper direction for stitching the stitching pattern 302. For example, starting from starting point 304 a user is directed to stitch in the direction indicated by direction indicator 312*a*. Sequence identifier 310*a* indicates the first stitching stroke to be completed. Sequence identifier 310*b* indicates the second stitching stroke to be completed and direction indicator 312*b* identifies the direction of the second stitching stroke.

Unique line styles may be used to indicate a change of direction in the stitching pattern 302. One novel feature of this embodiment is that the instructional marks and stitching pattern are unified wherein the type of line used gives instruction to the user. For example, line style 308 is a dashed line having long dashes. Line style 306 on the other hand is a line having shorter dashes and line style 309 is a solid line. As indicated above a user directed to stitch in the direction indicated by direction indicator 312*a*. Line style 306 helps identify the correct stitching stroke to follow. Once the user reaches point 314 the line style changes to line style 309. Sequence identifier 310*b* signals the user to follow the stitching pattern 302 in the direction indicated by direction indicator 312*b*. The user then follows the solid line of line style 309 back to the starting point 304. Sequence identifier 310*c* directs the user to follow the stitching pattern 302 in the direction indicated by direction indicator 312*c*. At starting point 304 the line style changes from solid line style 309 to a long dashed line style 308 signaling a change in direction for the stitching stroke. In this fashion a user works their way through the stitching pattern 302 following the direction indicators 312*d*-312*l* in the sequence indication by sequence identifiers 310*d*-310*l*.

In the embodiment illustrated in FIG. 3 sequence identifiers 310*a*-310*l* include an alphabetic identifier to be followed in alphabetic order. In other embodiments sequence identifiers 310*a*-310*l* may include any numeric, symbolic or other identifiers that indicate a proper sequence for sewing stitching pattern 302.

Figure 4:
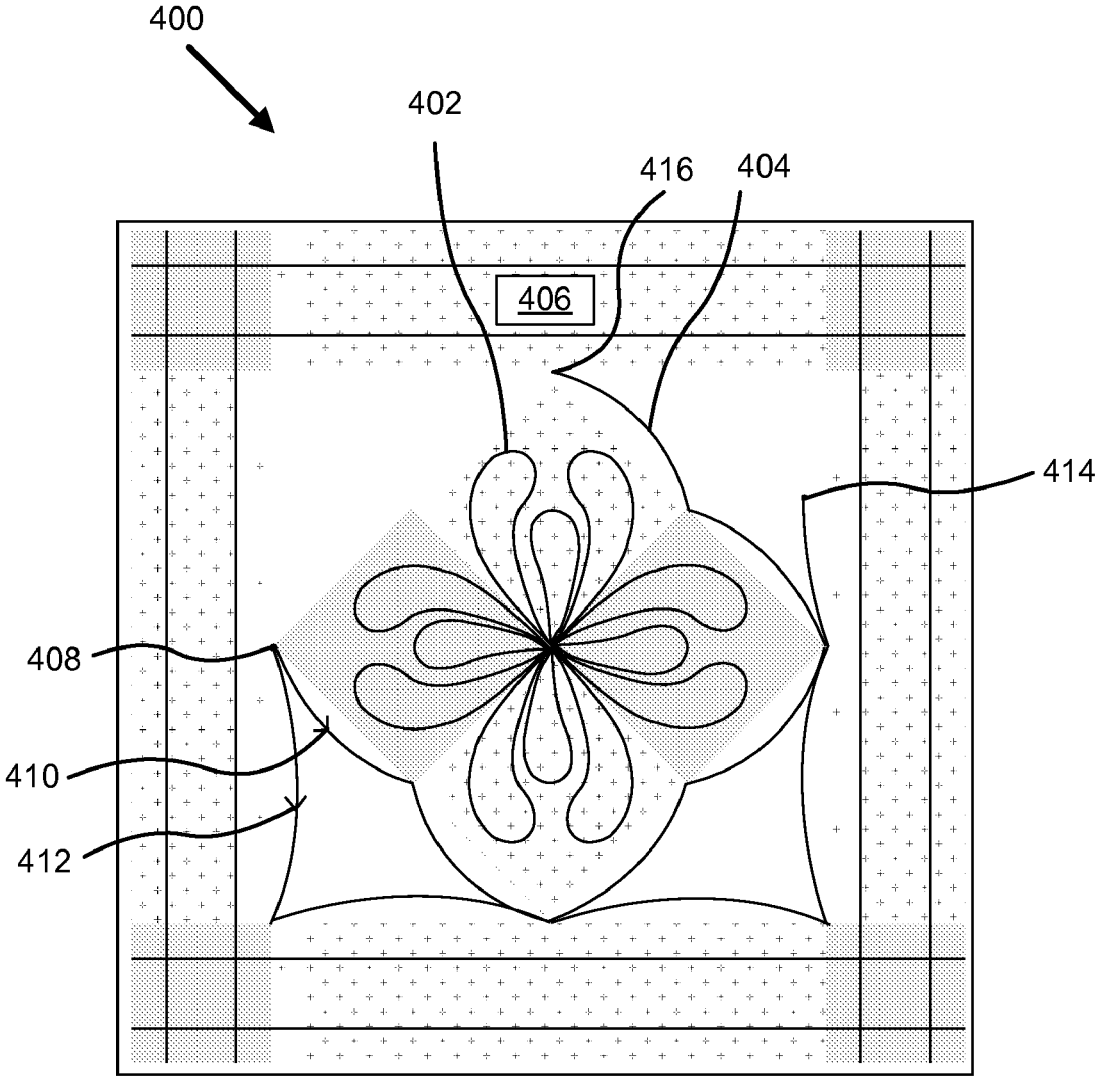
FIG. 4 is a top view illustration an embodiment of background pattern having an extrapolation stitching pattern printed thereon in accordance with the present invention.

FIG. 4 illustrates one embodiment of a system 400 for facilitating the instruction of quilting techniques including an extrapolation stitching pattern. The system 400 includes a center feather stitching pattern 402 and a continuous curve extrapolation stitching pattern 404 printed on background 406. In certain embodiments the system 400 includes one of the additional stitching patterns 154 and background patterns 156 of system 100 such as stitching pattern 124 and background pattern 122. In another embodiment the system 400 includes a complete system for facilitating the instruction of quilting techniques.

The center feather stitching pattern 402 facilitates the practice of registering a quilting stitching design within a quilted fabric design of the background pattern 406. One skilled in the art will recognize that it is not the particular design that is important but rather the practice of stitching a stitching pattern within the confines of the geometric pattern of the background pattern. Thus, other stitching designs may be printed on other background patterns and still be within the scope of the present invention.

The continuous curve extrapolation stitching pattern 404 facilitates the extrapolation of a stitching design from a partial stitching pattern. A starting point 408 indicates the starting position for stitching the continuous curve extrapolation stitching pattern 404. The stitching stroke proceeds in the direction of direction indicator 410 or direction indicator 412. Once the user reaches extrapolation point 414 or extrapolation point 416 the user must extrapolate the remaining portion of the continuous curve extrapolation stitching pattern 404 to return to the starting point 408. The user then proceeds either in the direction of direction indicator 410 or the direction of the direction indicator 412 depending on which portion of the continuous curve extrapolation stitching pattern 404 remains unstitched.

Figure 5:
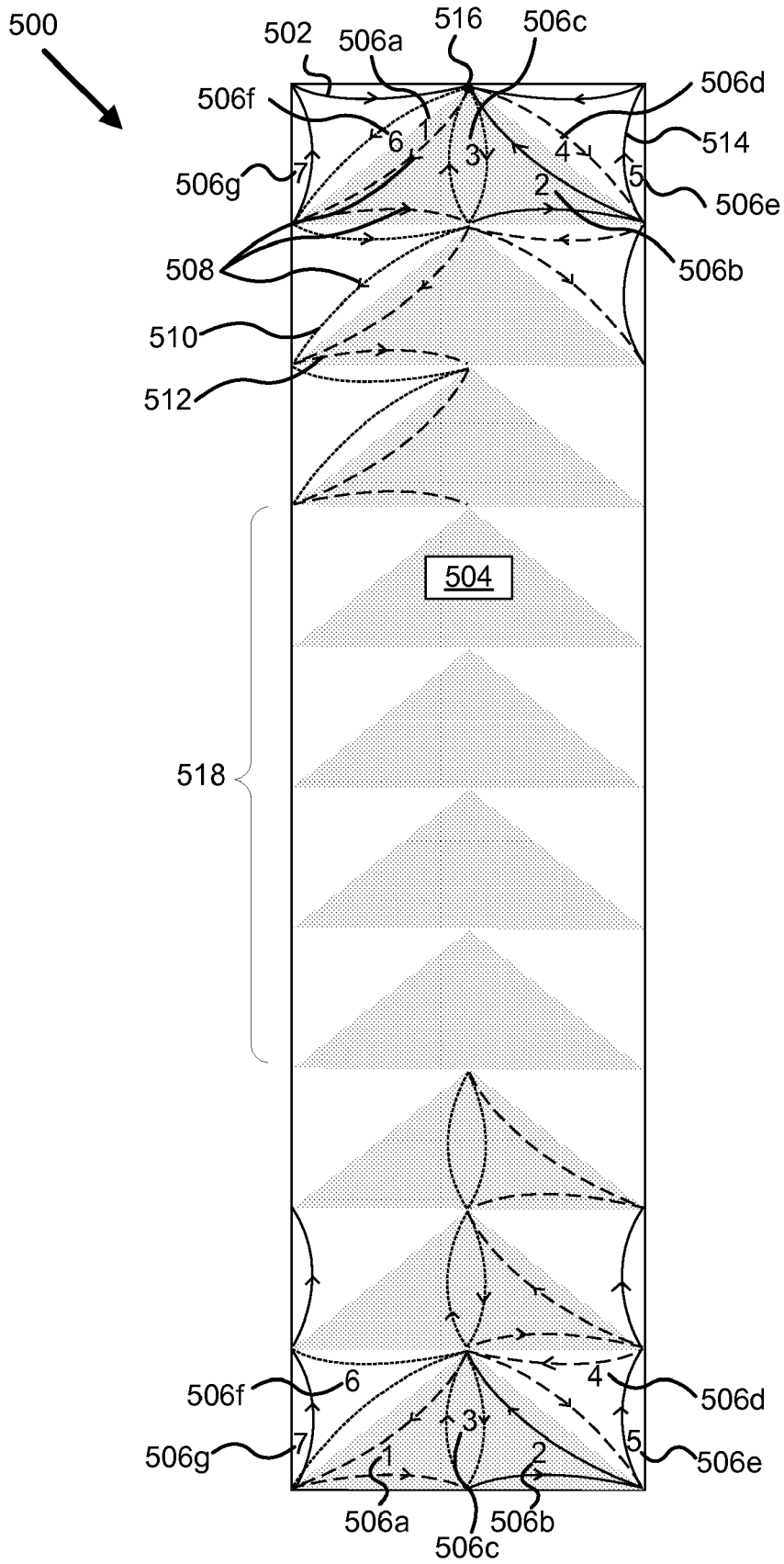
FIG. 5 is a top view illustrating an embodiment of a background pattern having an extrapolation stitching pattern and a plurality of stitching stroke sequence identifiers printed thereon in accordance with the present invention.

FIG. 5 illustrates an embodiment of a system 500 for facilitating the instruction of quilting techniques which includes an extrapolation stitching pattern 502, sequence identifiers 506*a*-506*g*, direction indicators 508, starting point indicator 516 and line styles 510, 512 and 514 printed on background pattern 504. In certain embodiments the system 500 includes one of the additional stitching patterns 154 and background patterns 156 of system 100 such as stitching pattern 150 and background pattern 148. In another embodiment the system 400 includes a complete system for facilitating the instruction of quilting techniques.

The starting point 516 indicates a stitching starting point with sequence identifiers 506*a*-506*g* indicating a preferred stitching stroke sequence in a manner substantially similar to the sequence identifiers 310*a*-310*l* of FIG. 3 as described above. Likewise, direction indicators 508 indicate the preferred direction of the stitching strokes in a manner substantially similar to direction indicators 312*a*-312*l* of FIG. 3.

Line styles 510, 512 and 514 assist the user in identifying differing stitching strokes. In certain embodiments each time a sequence of stitching strokes changes the line style 510, 512 or 514 may change. In one embodiment the stitching stroke may include a single line style such that the stitching strokes are only identified by the sequence identifiers 506*a*-506*g* and direction indicators 508.

The embodiment illustrated in FIG. 5 shows an extrapolation stitching pattern 502 wherein the user must extrapolate the portion of the stitching pattern 502 which has not been printed. Thus, to complete the stitching pattern 502 the user must continue the various stitching strokes throughout the middle portion 518 of the background pattern 504.

Figure 6:
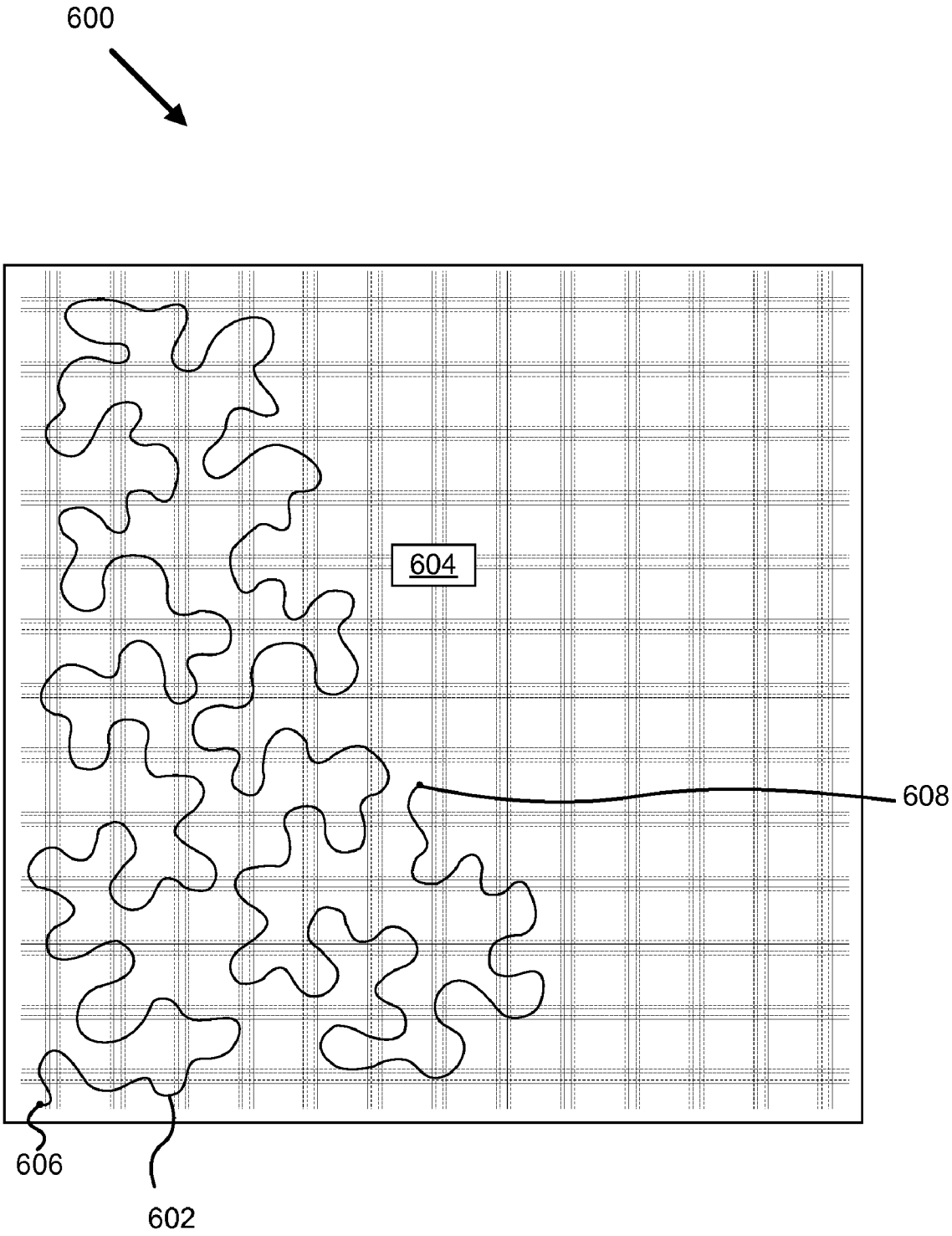
FIG. 6 is a top view illustrating an embodiment of a background pattern having a stippling stitching pattern printed thereon in accordance with the present invention.

FIG. 6 illustrates an embodiment of a system 600 for facilitating the instruction of quilting techniques which includes a stipple stitching pattern 602 printed on background pattern 604. In certain embodiments the system 500 includes one of the additional stitching patterns 154 and background patterns 156 of system 100 such as stitching pattern 144 and background pattern 142. In another embodiment the system 400 includes a complete system for facilitating the instruction of quilting techniques.

A user begins stitching the stipple stitching pattern 602 at starting point 606 following the stitching pattern until the user reaches the extrapolation beginning point 608. Once the user reaches the extrapolation beginning point 608 the user must extrapolate the remainder of the stitching pattern 602 if the user wishes to complete the stitching of the background pattern 604.

Figure 7:
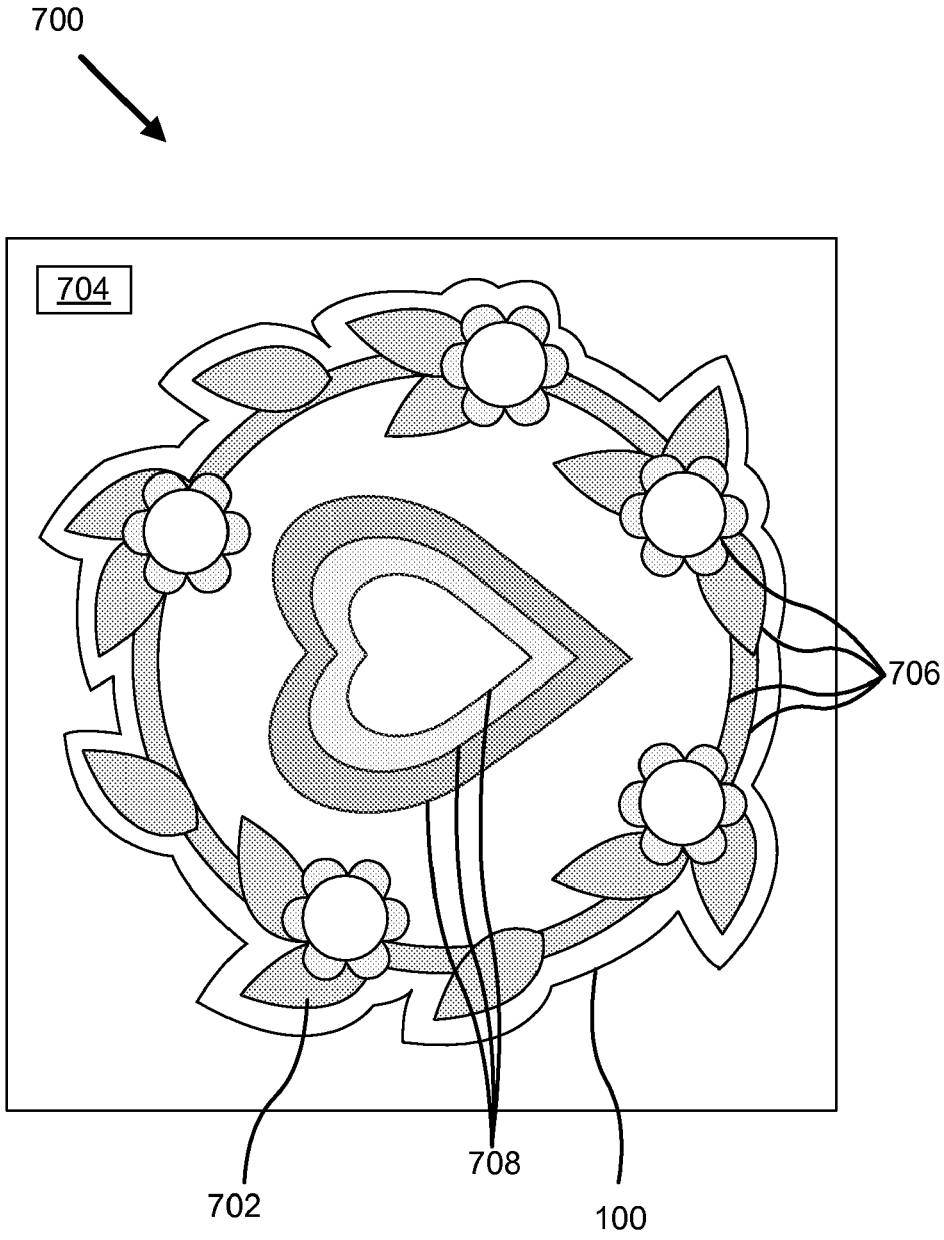
FIG. 7 is a top view illustrating an embodiment of a simulated appliqué stitching pattern in accordance with the present invention.

FIG. 7 illustrates an embodiment of a system 700 for facilitating the instruction of quilting techniques which includes a simulated appliqué 702 printed on a background 704. In the embodiment illustrated in FIG. 7 the simulated appliqué 702 is printed on a blank background 704. However, one skilled in the art will recognize that in certain embodiments the simulate appliqué 702 may be printed on a background 704 which may have a background pattern printed thereon. Further, one skilled in the art will recognize that the particular design of the simulated appliqué 702 is not important and that the simulated appliqué 702 may be illustrated as other designs.

In use the system 700 facilitates the practice of stitching an appliqué. The user stitches the lines 706 around the outer portion of the simulated appliqué 702 and the lines 708 around the inner portion of the simulated appliqué 702. The user may also practice echoing the simulated appliqué 702 by stitching echo stitching pattern 710. The user may extrapolate additional echo stitching patterns around the perimeter of echo stitching pattern 710.

Figure 8:
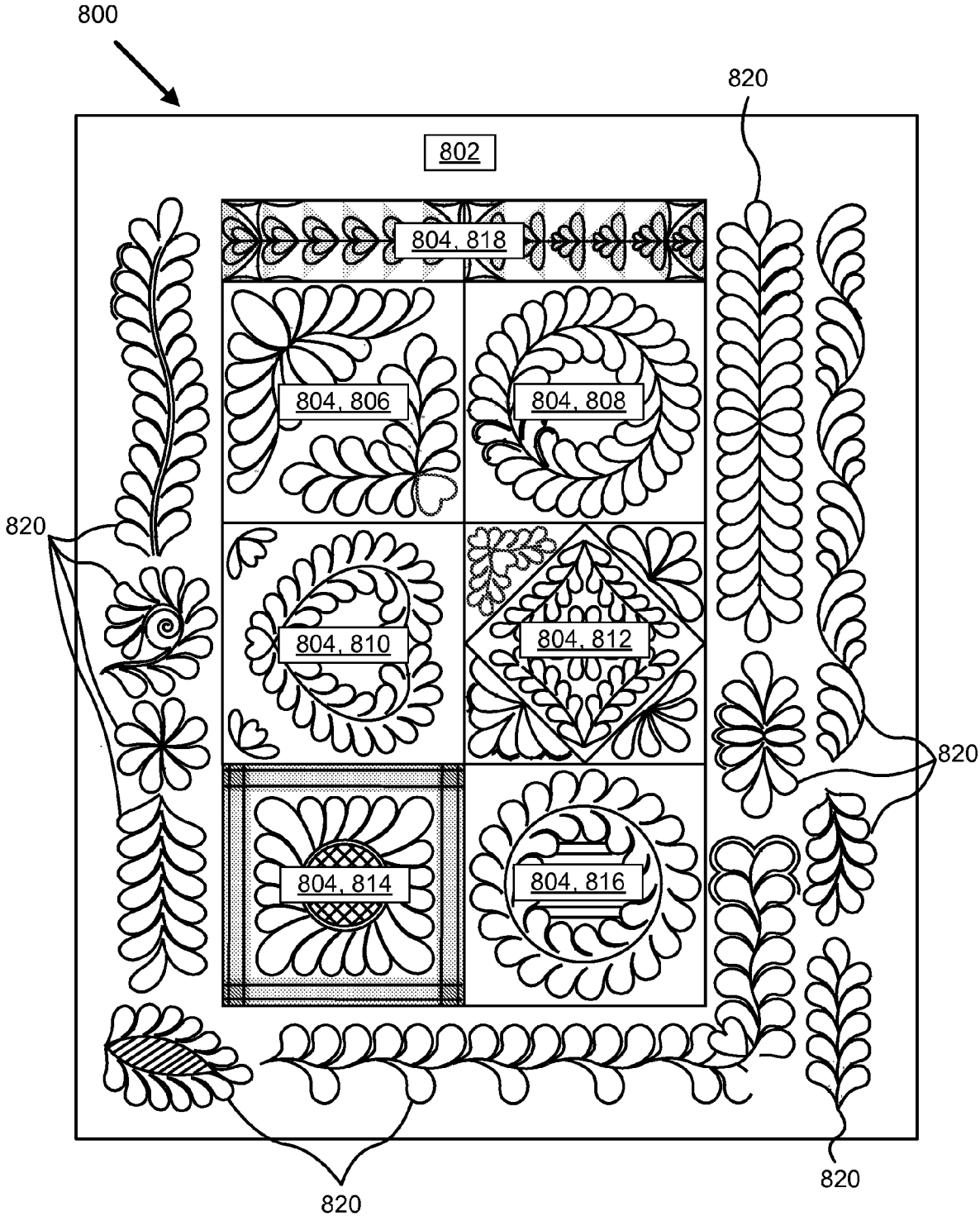
FIG. 8 is a top view illustrating one embodiment of a fabric panel containing a plurality of background patterns and advanced stitching patterns in accordance with the present invention.

FIG. 8 illustrates an embodiment of a system 800 for facilitating the instruction of quilting techniques which includes a fabric panel 802 containing an incrementally more difficult set of advanced stitching patterns 804 than the additional stitching patterns 154 or the common stitching patterns illustrated in areas 104, 106, 108, 110, and 112 of system 100 illustrated in FIG. 1. The advanced stitching patterns 804 may be illustrated on a solid background such as backgrounds 806, 808, 810, 812 and 816 or the advanced stitching patterns 804 may be illustrated on a patterned background such as patterned background 814 or patterned background 818. In certain embodiments a set of complex stitching patterns 820 may be illustrated around the perimeter of the backgrounds 806-818 to facilitate the practice of stitching complex stitching designs.

Once a user has mastered system 100 the user may increase their quilting skills by practicing the advanced stitching patterns 804 of system 800. In certain embodiments additional incrementally more difficult stitching patterns may be illustrated on additional fabric panels 802 to facilitate the instruction of increasingly more difficult quilting techniques.

Figure 9:
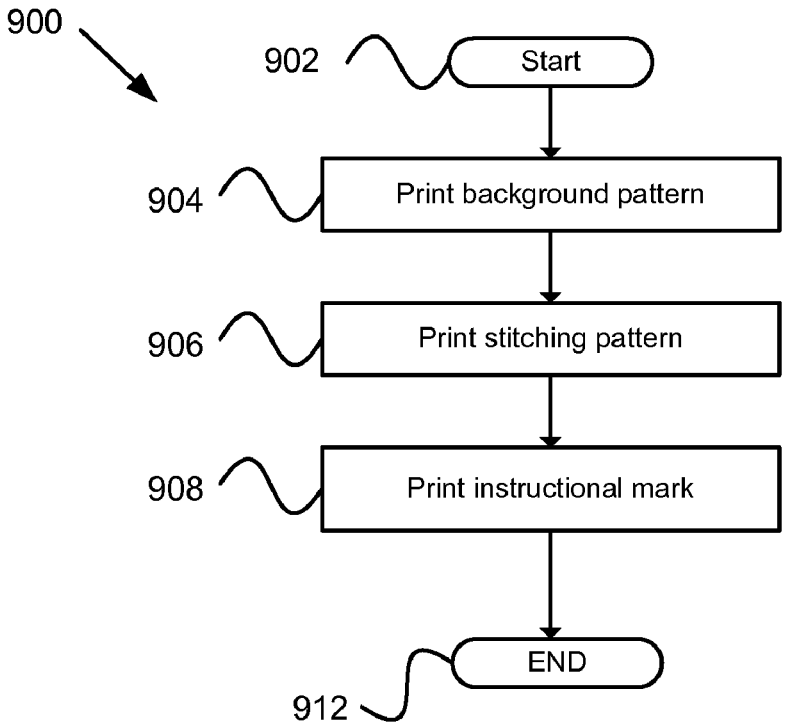
FIG. 9 is a schematic block diagram illustrating one embodiment of a method for facilitating the instruction of quilting techniques in accordance with the present invention.

FIG. 9 is a schematic flow chart diagram illustrating one embodiment of a method 900 for facilitating the instruction of quilting techniques. The method 900 starts 902 and a background pattern is printed 904 on a fabric panel. A stitching pattern is also printed 906 on the fabric panel. In certain embodiments the stitching pattern is printed 906 on top of the background pattern. In other embodiments the stitching pattern is printed on directly on the fabric panel instead of on the background. At least one instructional mark is printed 908 on the fabric panel and the method ends 912. In one embodiment the printing 904 of the background pattern, the printing of stitching pattern 906 and the printing 908 of the instruction marks occur simultaneously. In another embodiment the background may be omitted such that only the stitching pattern and the at least one instructional mark are printed on the fabric panel.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for facilitating the instruction of quilting techniques, the apparatus comprising:

a background pattern printed on a fabric panel, the fabric panel comprising a length of fabric, the background pattern comprising a plurality of geometric shapes simulating one or more quilted fabric designs found on a quilted fabric;

a stitching pattern printed on the fabric panel, the stitching pattern comprising at least one quilting stitching design, the stitching pattern defining a guideline for stitching the quilting stitching design; and at least one instructional mark printed on the fabric panel, the at least one instructional mark defining a quilting instruction that guides a user stitching the stitching pattern, the at least one instructional mark selected from at least one of a label defining an ending point for ending stitching of the stitching pattern, a label identifying a direction to stitch the stitching pattern, and a sequence identifier identifying a proper sequence of stitching strokes.

2. The apparatus of claim 1, wherein the stitching pattern illustrates a first portion having a continuous uninterrupted guideline illustrating the at least one quilting stitching design, the stitching pattern having a second portion having at least one interrupted section wherein the guideline illustrating the at least one quilting stitching design is interrupted.

3. The apparatus of claim 1, wherein the plurality of geometric shapes comprising the background pattern are arranged in a repeating pattern to simulate a patchwork quilt, wherein the stitching pattern is printed on top of the background pattern such that the stitching pattern facilitates the practice of registering the quilted stitching design within the quilted fabric design of the background pattern.

4. The apparatus of claim 1, further comprising a stitching device, the stitching device selected from the group consisting of a conventional sewing machine, a long arm sewing machine and a needle and thread, wherein the user stitches the stitching pattern using the stitching device according to the quilting instruction defined by the at least one instructional mark.

5. The apparatus of claim 1, wherein the at least one instructional mark comprises a label defining a starting point for beginning stitching of the stitching pattern.

6. The apparatus of claim 1, wherein the at least one instructional mark comprises a label defining an ending point for ending stitching of the stitching pattern.

7. The apparatus of claim 1, wherein the at least one instructional mark comprises a label identifying a direction to stitch the stitching pattern.

8. The apparatus of claim 1, wherein the stitching pattern comprises a plurality of stitching strokes, wherein the at least one instructional mark comprises a sequence identifier identifying a proper sequence of stitching strokes for completion of the stitching pattern.

9. The apparatus of claim 8, wherein the each stitching stroke comprises a unique line style such that each stitching stroke is distinguishable from another stitching stroke.

10. The apparatus of claim 1, wherein the stitching pattern and the at least one instructional mark are printed using a removable material such that the stitching pattern and the at least one instructional mark may be removed after the stitching pattern has been stitched.

11. The apparatus of claim 10, wherein the removable material comprises a washable ink.

12. A system to for facilitating the instruction of quilting techniques, the system comprising:

a first fabric panel comprising a length of fabric for receiving a background pattern and a stitching pattern;

a first background pattern printed on the first fabric panel, the first background pattern comprising a plurality of geometric shapes arranged in a repeating pattern to simulate a patchwork quilt;

a first stitching pattern comprising at least one quilting stitching design, the first stitching pattern defining a guideline for stitching the quilting stitching design, wherein the first stitching pattern is printed on top of the first background pattern to facilitate the practice of stitching the at least one quilting stitching design within the repeating pattern of the first background pattern; and at least one instructional mark printed on the first fabric panel, the at least one instructional mark defining a quilting instruction that guides a user stitching the first stitching pattern, wherein the quilting instruction comprises one or more of an instruction selected from a label defining a starting point, a label defining an ending point, a label identifying a direction to stitch the stitching pattern and a sequence identifier identifying a proper sequence of stitching strokes for completion of the stitching pattern.

13. The system of claim 12, wherein the stitching pattern illustrates a first portion having a continuous uninterrupted guideline illustrating the at least one quilting stitching design, the stitching pattern having a second portion having at least one interrupted section wherein the guideline illustrating the at least one quilting stitching design is interrupted.

14. The system of claim 12, the system further comprising:

a second fabric panel comprising a length of fabric for receiving a second background pattern and a second stitching pattern;

a second background pattern printed on the second fabric panel, the second background pattern comprising a plurality of geometric shapes arranged in a repeating pattern to simulate a patchwork quilt;

a second stitching pattern printed on the second fabric panel, the second stitching pattern comprising a quilting stitching design that is incrementally more difficult to stitch than the quilting stitching design of the first stitching pattern; and at least one instructional mark printed on the second fabric panel, the at least one instructional mark defining a quilting instruction that guides a user stitching the second stitching pattern.

15. A method for facilitating the instruction of quilting techniques, the method comprising:

printing a background pattern on a fabric panel, the fabric panel comprising a length of fabric, the background pattern comprising a plurality of geometric shapes simulating one or more quilted fabric designs found on a quilted fabric;

printing a stitching pattern on the fabric panel, the stitching pattern comprising at least one quilting stitching design, the stitching pattern defining a guideline for stitching the quilted stitching design; and printing at least one instructional mark on the fabric panel, the at least one instructional mark defining a quilting instruction comprising one or more of an instruction selected from a label defining a starting point for beginning stitching of the stitching pattern, a label defining an ending point for ending stitching of the stitching pattern, a label identifying a direction to stitch the stitching pattern and a sequence identifier identifying a proper sequence of stitching strokes for completion of the stitching pattern.

16. The method of claim 15, wherein the stitching pattern illustrates a first portion having a continuous uninterrupted guideline illustrating the at least one quilting stitching design, the stitching pattern having a second portion having at least one interrupted section wherein the guideline illustrating the at least one quilting stitching design is interrupted.

17. The method of claim 15, wherein the plurality of geometric shapes comprising the background pattern are arranged in a repeating pattern to simulate a patchwork quilt, wherein the stitching pattern is printed on top of the background pattern such that the stitching pattern facilitates the practice of registering the quilted stitching design within the quilted fabric design of the background pattern.

18. The method of claim 15, wherein the user is guided to stitch the stitching pattern using a stitching device, the stitching device selected from the group consisting of a conventional sewing machine, a long arm sewing machine and a needle and thread.

19. The method of claim 15, further comprising guiding a user to stitch the stitching pattern according to the at least one instructional mark.

* * * * *